US006500007B2

(12) United States Patent
Pupulin

(10) Patent No.: US 6,500,007 B2
(45) Date of Patent: Dec. 31, 2002

(54) APPARATUS FOR ENTERTAINMENT AND EDUCATION AND METHOD OF USE

(76) Inventor: Dennis B. Pupulin, 14140 Riverside Dr., East Windsor, Ontario (CA), N8N 1B6

( * ) Notice: Subject to any disclaimer, the term of this patent is extended or adjusted under 35 U.S.C. 154(b) by 0 days.

(21) Appl. No.: 09/793,440

(22) Filed: Feb. 27, 2001

(65) Prior Publication Data

US 2002/0119725 A1 Aug. 29, 2002

(51) Int. Cl.[7] ..... G09B 1/36

(52) U.S. Cl. ..... 434/171; 446/111; 446/115; 273/157 R; 434/89

(58) Field of Search ..... 434/85, 81, 89, 434/211, 171, 172, 175, 176, 177; 446/108, 111, 112, 113, 115, 116, 127, 128, 122; 273/157 R, 156

(56) References Cited

U.S. PATENT DOCUMENTS

| | | | | |
|---|---|---|---|---|
| 2,150,707 A | | 3/1939 | Anderson | |
| 3,726,027 A | | 4/1973 | Cohen et al. | |
| 4,165,077 A | * | 8/1979 | Falcione | 273/239 |
| 4,212,130 A | | 7/1980 | Walker | |
| 4,345,762 A | | 8/1982 | Lebelson | |
| 4,365,454 A | * | 12/1982 | Davis | 52/586 |
| 4,529,385 A | * | 7/1985 | Reiner et al. | 434/171 |
| 4,597,579 A | | 7/1986 | Walton | |
| 4,852,878 A | | 8/1989 | Merrill | |
| 4,969,568 A | | 11/1990 | Yoshida | |
| 5,251,900 A | | 10/1993 | Gallant | |
| 5,344,148 A | | 9/1994 | Asch | |
| 5,411,262 A | | 5/1995 | Smith | |
| 5,482,491 A | * | 1/1996 | Kichijyo | 446/112 |
| 5,487,690 A | | 1/1996 | Stoffle et al. | |
| 5,605,486 A | | 2/1997 | Zheng | |
| 5,823,531 A | | 10/1998 | Huber | |
| 5,860,650 A | | 1/1999 | Scobbie et al. | |
| 5,873,729 A | | 2/1999 | Aghevli | |

* cited by examiner

*Primary Examiner*—Kien T. Nguyen
(74) *Attorney, Agent, or Firm*—Clark & Brody

(57) ABSTRACT

A game apparatus of education and entertainment purposes comprises a number of building pieces and a number of connector pieces. The building pieces have peripheral edges that employ slots to receive complementary sized portions of the connector pieces. The connector pieces have a number of different configurations to permit creation of a variety of three dimensional shapes, including arranging building pieces at right angles, and oblique angles. The building pieces can have indicia thereon to create text, images, or combinations thereof when put together. The building pieces are modularly sized so that differently shaped and sized pieces can easily fit together.

17 Claims, 3 Drawing Sheets

31
35
33
33

37
39
b
c 41
45
47
43

51
54
53
52 a
61
62
63

71
72
75
81
75
74
73
7
77
79

7
79

81
3'
81

86
88
90
82
3
81

APPARATUS FOR ENTERTAINMENT AND EDUCATION AND METHOD OF USE

FIELD OF THE INVENTION

The present invention is directed to an apparatus for entertainment and education and a method of use, and in particular, to an apparatus employing a number of interlocking pieces that allow for the construction of three dimensional shapes, and that include indicia with the pieces for educational purposes during construction of the shapes.

BACKGROUND ART

In the prior art, various games and apparatus have been proposed that utilize interlocking pieces. U.S. Pat. No. 5,251,900 to Gallant discloses a three-dimensional puzzle structure that employs pieces that are irregular and polygonal shaped, and pieces that are flat planar blocks. The pieces are interlocked with dovetail joints.

U.S. Pat. No. 2,150,707 to Anderson discloses building blocks and a building assembly, wherein the blocks are joined together using a tongue and groove construction. The tongue and groove construction allows for constructing assemblies, which are basically right angled.

U.S. Pat. No. 4,212,130 to Walker discloses a playhouse with elements based on two modular units. The playhouse is made up of panels and bendable strips are used to link the panels together.

U.S. Pat. No. 5,487,690 to Stoffle et al. discloses clamps for a free standing play structure. The clamps connect panels together in right angle, straight or angled configurations.

While the prior noted above suggests tongue and groove connection in various game and building apparatus, none of the prior art noted above allows for construction of shapes in a wide variety of configurations and ones that allow for creativity input by the builder. As such, a need exists to provide improved apparatus allowing for construction of three dimensional shapes using a number of modular pieces, and including modes of construction that couple shape making with educational/entertainment objectives such as image or text message creations or combinations thereof.

SUMMARY OF THE INVENTION

It is a first object of the present invention to provide an improved apparatus having both entertainment and education use.

Another object of the invention is an apparatus that allows for the creation of three-dimensional shapes.

Yet another object of the invention is a method of using the inventive apparatus wherein the pieces are manipulated to make various shapes for entertainment and/or education.

Other objects and advantages of the present invention will become apparent as a description thereof proceeds.

In satisfaction of the foregoing objects and advantages, the present invention provides an interlocking apparatus for education and entertainment comprising a plurality of building pieces and a plurality of connector pieces. Each building piece further comprises a building piece portion having a periphery, a first thickness, and opposing first and second faces. The periphery includes a first connector portion extending along at least a portion of the periphery, the first connector portion having a second thickness, and having one of a slot or a protrusion.

Each connector piece has at least a pair of second connector portions, each second connector portion being complementary to the first connector portion by having a slot if the first connector portion has a protrusion or a protrusion if the first connector portion has a slot, so that one building piece can be connected to another building piece using a connector piece. A set of the plurality of the connector pieces have second connector portions that are right angled with respect to each other and another set of the plurality have second connector portions that are obliquely angled with respect to each other, whereby a three dimensional figure can be built using the building pieces and connector elements.

In a preferred embodiment, the first connector portions have a slot and the second connector portions have a protrusion. The first connector portion can extend along the entire periphery of the building piece. Each building piece and each connector piece is preferably made of a rigid non-metallic material, such as a hard plastic.

The plurality of connector pieces can include a number of configurations such as connector pieces that are: right-angled with a pair of second connector portions; are t-shaped with three connector portions; have a pair of right-angled connector portions (cross-shaped); and have a pair of second connector portions that are right-angled and a third connector portion which is angled at about 45° from one of the right-angled connector portions.

The connector portions of the building pieces can be sized so that a recess is formed portion in one-face of the building piece, and the other opposing face can be generally flat.

A portion of the building pieces can have indicia on at least one of the first and second faces, and the indicia can form one of an image or text message, or a combination thereof particularly when pieces are joined together.

The periphery of each building piece can made up of a plurality of edges, with at least two edges being right angled. Dimensions of the right angled edges of the plurality of connector pieces are in multiples of a base dimension so that either individual building pieces can be connected together or an individual building piece can connect to at least two building pieces.

Each connector piece can have a body portion with each second connector portion extending therefrom, the body portion including a lip on either side of the connector portion, the lip abutting a peripheral edge of a the first connector portion when the connector piece is adjacent a building piece. The body portion is sized with respect to the second connector portion so that a body portion surface is interposed between surfaces of adjacent building pieces to form a continuous generally flat surface between the adjacent building pieces.

The invention also entails a method of forming a game apparatus by providing the building pieces and connector pieces, selecting a number of game pieces and connector pieces, and connecting the game pieces together using the connector pieces to make a desired structure. The structure can be assembled using indicia on the building pieces to create text, images or combinations thereof.

BRIEF DESCRIPTION OF THE DRAWINGS

Reference is now made to the drawings of the invention wherein.

DESCRIPTION OF THE PREFERRED EMBODIMENTS

The present invention provides significant advantages in the field of toys and games for both entertainment and education. With the inventive apparatus, three-dimensional shapes can be constructed with easy-to-use connector pieces and building pieces. In addition, the building pieces can be modified with indicia such as images and/or text, or combinations thereof to integrate the shape construction with an image and/or text construction as well.

Figure 1:
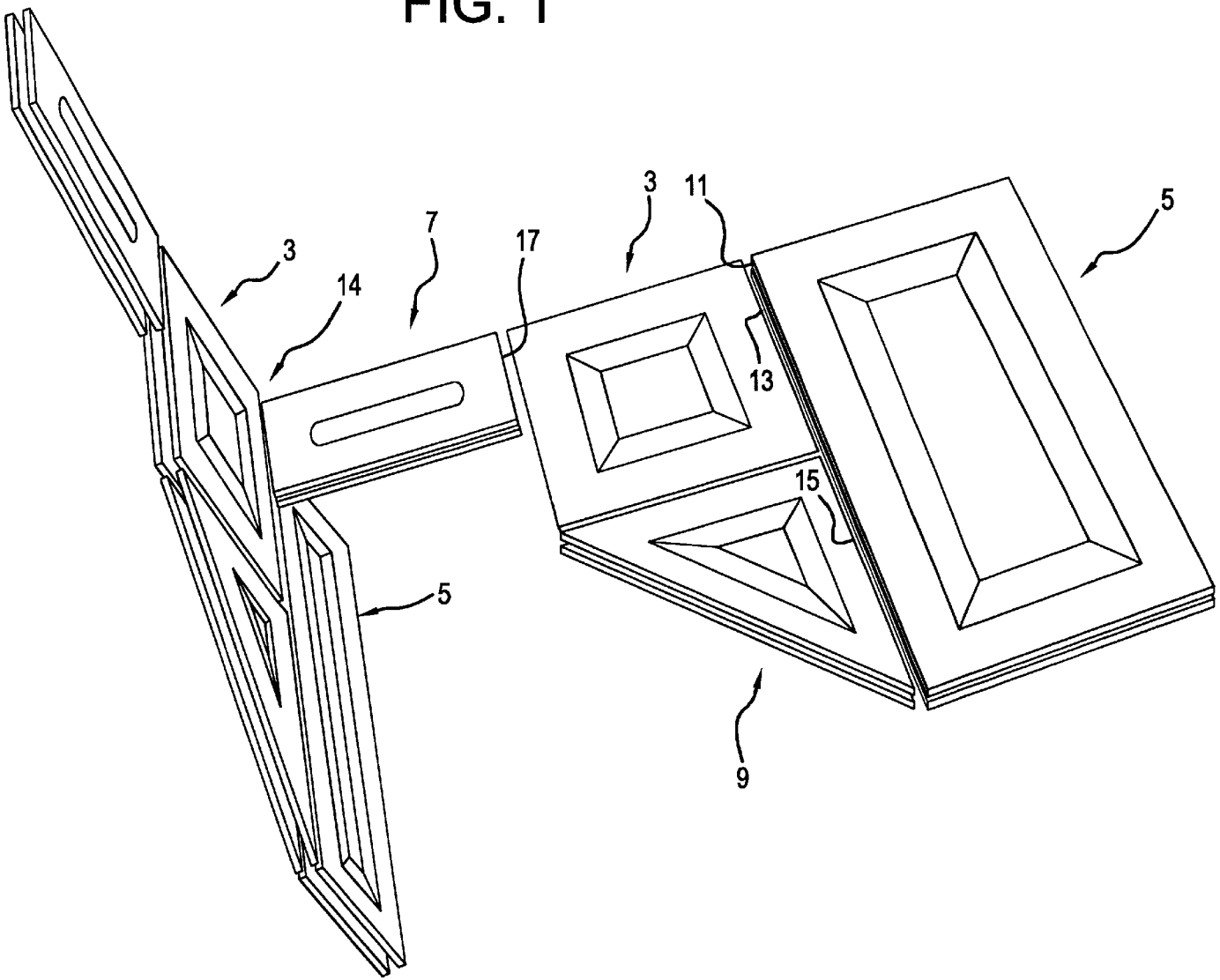
FIG. 1 is a perspective view of a shape constructed using the building and connecter pieces of the invention.

FIG. 1 shows one embodiment of the invention in a partially-built shape. The apparatus of this figure is made up of a number of building pieces. The building pieces have a number of shape configurations to allow for flexibility and creativity when putting the pieces together. In FIG. 1, there are shown square pieces 3, large rectangular pieces 5, smaller rectangular pieces 7, and triangular pieces 9. In this embodiment, the pieces are modularly dimensioned based on a base dimension, such as one inch. Of course, other base dimensions can be used. With the base dimension, and each piece having a side with the base dimension or a multiple thereof, the pieces can be put together in a number of ways.

As can be seen from FIG. 1, the large rectangle has an edge 11, which is four times the base dimension, i.e., edge 17 of piece 7. This edge 11 can accommodate the edge 13 of the square piece 3, which is two times the base dimension, and the edge 15 of the triangular piece 9.

In FIG. 1, a three dimensional shape is portrayed by a right angle connection between the small rectangular shape 7 and the square piece 5 and the large rectangular piece 5. The pieces in FIG. 1 are held together by a number of connector pieces as shown in FIGS. 2*a*–2*e*, and 5*a*–5*c*. The connector pieces are not shown in FIG. 1 for clarity.

Figures 2A, 2B, 2C, 2D, 2E, 3A, 3B, 4A, 4B:
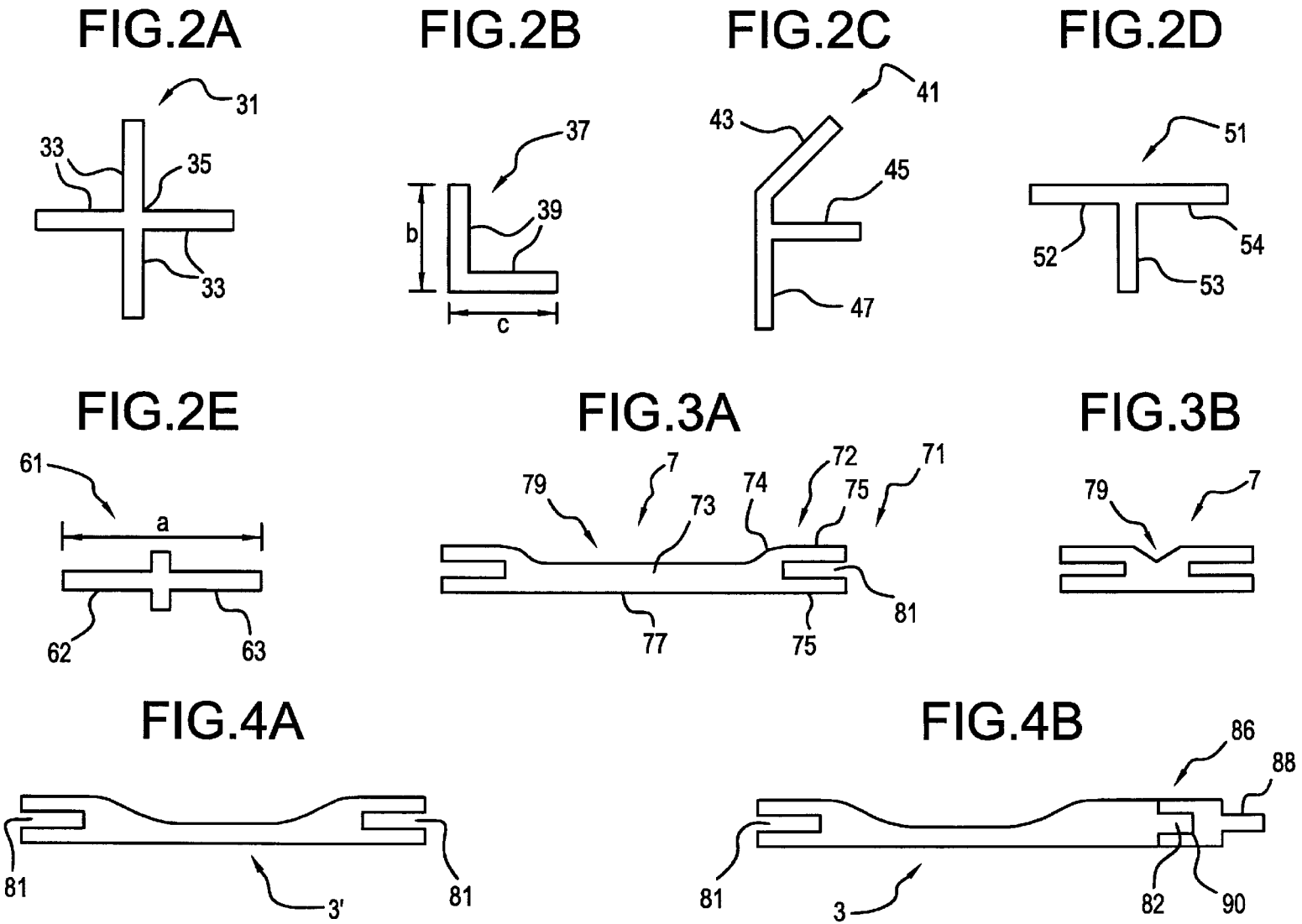
FIGS. 2*a–e* are end views of connecter pieces of the inventive apparatus.
FIG. 3*a* is a cross sectional view along a long dimension of one type of a rectangular building piece.
FIG. 3*b* is a cross sectional view along the short dimension of the building piece of FIG. 3*a;*
FIGS. 4*a* and 4*b* are ninety degree opposed cross sectional views of an alternative square building piece and connector piece combination.

The connector pieces come in a variety of configurations, both in terms of cross section and length. FIG. 2*a* depicts a connector piece 31 having four right-angled connector portions 33 joined at a center 35. This connector can link up to four building pieces together.

FIG. 2*b* shows a right-angled connector piece 37 having a pair of connector portions 39, thus allowing for connecting two building pieces together in a right angle.

FIG. 2*c* depicts a connector piece 41 allowing for a non-right angle or oblique connection. In this piece, one connector portion 43 extends at an oblique angle, shown as 45° degrees, from another connector portion 45. A third connector portion 47 is right angled with respect to the connector portion 45. It should be understood that the connector piece 41 is exemplary and other configurations can be employed that combine one connector portion that is obliquely or non-right angled with respect to at least one other connector portion. For example, the embodiment of FIG. 2*c* could have another portion extending 90° from the portion 43 so that two obliquely-angled connector portions exist, forming y-shaped connector portions. The FIG. 2*c* connector piece allows connection of at least two pieces whereby the angle between them is oblique rather than right angled.

FIG. 2*d* shows a t-shaped connector 51 having three connecting portions 52, 53, and 54. The adjacent portions 52 and 53, and 53 and 54 are at 90° angles, respectively. This connector allows a three piece connection as shown at 14 in FIG. 1.

FIG. 2*e* shows another connector piece 61. that has connecting portions 62 and 63. This piece link two pieces together as shown in FIG. 1, pieces 3 and 9 to piece 5.

The connector pieces can have any length. For example, the length could be the base dimension, or a multiple thereof. Alternatively, the length could be less than the base dimension.

The length of each connection portion relates to the manner of connection to the building pieces. Referring to the cross sectional views of FIGS. 3*a*–5*b*, the building pieces are made with slots to receive the connecting portions of the connector pieces. FIGS. 3*a* and 3*b* shows the small rectangular piece 7. The piece 7 has a periphery 71, a body portion 73, and a surrounding connector portion 72 having connection legs 75. The piece 71 has a generally flat surface 77 and a recessed opposing surface 79. The recessed surface is formed by the body portion 73 having a thickness less than that of the connecting portion 72. The junction 74 between leg 75 and 73 is sloped to give the smooth recessed look of the pieces as shown in FIG. 1.

The connection legs 75 form a slot 81 that is sized to receive the connecting portions of the connection pieces of FIGS. 2*a*–2*e*. When the pieces are connected, the connecting portion of the connector pieces engages the slot of the connection portions of the building pieces.

FIG. 4*a* shows one view of an alternative square piece 3' and connector piece- combination in cross section, with FIG. 4*b* showing another view juxtaposed 90 degrees. While each view shows that the adjacent sides are generally equal, FIG. 4*b* shows a protrusion 82 in place of the slot 81 for connection purposes. A connector piece 86 is also shown in FIG. 4*b* which combines a connector portion 88 and a connector slot 90.

As noted above, the building pieces can have a variety of shapes in triangular. The corners of the pieces can be rounded as well. For example, the triangular piece shown in FIG. 1 can have radiused corners e.g., 1/64 inch, or the corners can terminate at a point.

In a preferred embodiment, the base dimension is approximately one inch, preferably 0.939", and the multiple dimensions then increase in increments of one inch, e.g., 1.939", two inches, 3.939", four inches, etc. Of course, other base dimensions could be employed.

The connector pieces are sized in conjunction with the connection portions of the building pieces to assure the right fit when assembling the pieces. For example, the thickness of each of the connecting portions of the pieces of FIGS. 2*a*–2*e* is approximately 0.063" to mesh with the width of each slot 81. Each connector piece portion also has a length sized to fit in the slot 81. Referring to FIG. 2*b*, if the distance "b" is 0.375 inches, and the thickness of the potion 39 is 0.063 inches, the length of the connecting piece available to fit with in the slot is 0.312 inches, dimension "c". As noted above, the dimensions of the connector piece portions and the slots 81 can vary.

The connector pieces can also have various lengths. Examples of lengths for the connector pieces to mesh with the exemplified building pieces include a short piece, 1.3125 inches, a medium piece, 3.3125 inches, and a long piece, 7.3125. Preferred dimensions for the width of the connector pieces is an overall width of opposing connector portions of 0.688 inches, "a" in FIG. 2*e*. A preferred dimension for angled connector portions is 0.375 inches, see "b" in FIG. 2

Figure 5A:
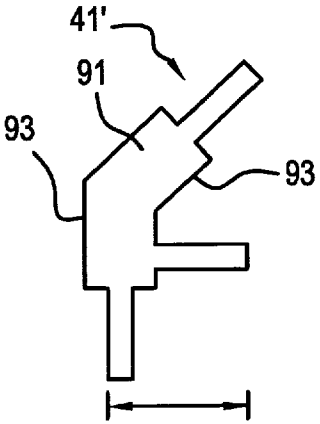
FIGS. 5*a*–5*c* show other embodiments of connector pieces.
Figure 5B:
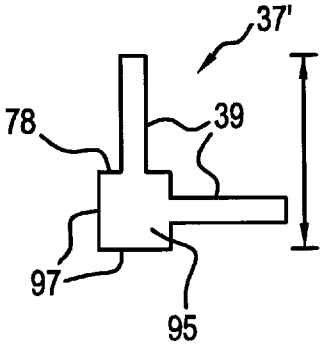
Figure 5C:
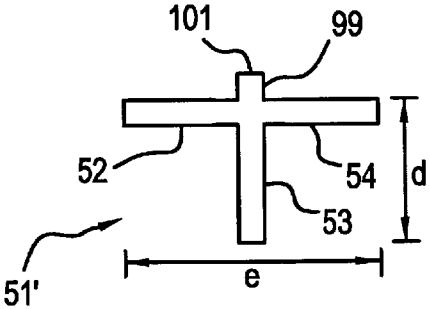

FIGS. 5*a*–5*c* show alternative connector pieces, wherein the connector piece has one or more portions designed to provide a mating surface between two building pieces. FIG. 5*a* shows a connector 41' with a body portion 91. The connector portions 43, 45, and 47 extend from the body portion 91. The portion 91 has mating surfaces 93 which fill a gap between two building pieces so that the adjacent building pieces form a continuous surface.

FIG. 5*b* shows connector 37' having a body portion 95, and connector portions 49. As with connector 41', the portion 95 has surfaces 97 that help form a continuous surface when two pieces are connected using connector portions 39. Likewise, FIG. 5*c* shows the t-shaped connector 51', with a body portion 99 and mating surface 101 to perform the same function as connector pieces 41' and 37'. In each embodiment, a step is formed between the connector portion and the body portion, see 78 in FIG. 5*b*. The step interfaces with the legs of the building pieces as described below.

Figure 6:
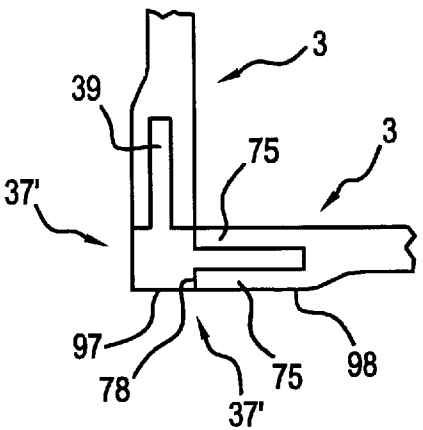
FIG. 6 shows a portion of a pair of building pieces interconnected by a connector piece.

The thickness of each of the connecting legs 75 of the building pieces is preferably sized in FIG. 6 to approximates the size of the step 78 so that the surface 97 mates with the surface 98 of the piece 3. This mating provides a smooth or continuous surface at the junction between the connector piece 37', and the building piece 3. In a preferred embodiment, the thickness of connecting portions of the connecting pieces 75 is also about the thickness of the connector piece portions, thus forming a total thickness of about 0.188 inches for the peripheral ends of the building pieces. The connector pieces having the body portion also define a length of the connector piece portions for mating with the slot 81 of the building pieces. That is, a preferred dimension "d", see FIG. 5*c* is 0.4375 inches, with the dimension "e" being 0.688 inches.

Figure 7:
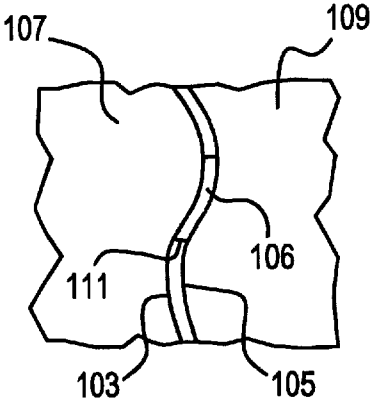
FIG. 7 shows a pair of non-linear building pieces joined by a non-linear connector piece.

In another embodiment, the building pieces can have irregular shapes and the connector pieces can be correspondingly sized and shaped to connect the. irregular shapes. Referring to FIG. 7, non-linear edges 103 and 105 of a portion of irregular building pieces 107 and 109 are linked by a connecting piece 111. Piece 111 is similar to piece. 61 shown in FIG. 2*e* for connecting two pieces in a planar fashion, but it has a portion similar to 99 in FIG. 5*c* to provide a surface 106 between the two building pieces.

Figure 8:
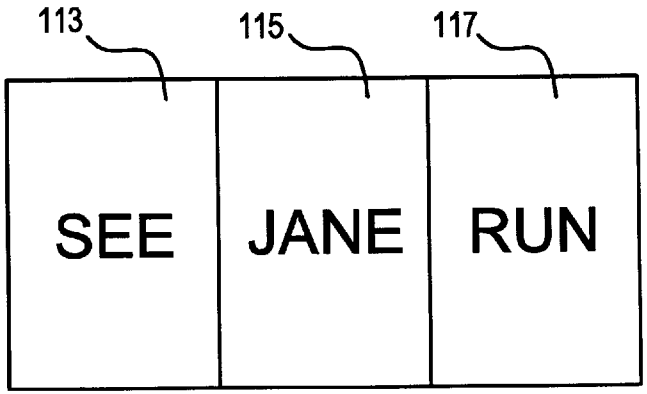
FIG. 8 shows a plurality of square building pieces with indicia thereon.

FIG. 8 shows the aspect of the invention wherein connecting building pieces creates a text message. Piece 113, 115, and 117 are linked to piece the sentence "SEE JANE RUN". Instead of a sentence, an image or a word could also be created by linking the appropriate and indicia-containing pieces together, e.g., "tr" and part of an image of a tree on one piece and "ee" and the remaining image of the tree on the other piece. When connecting these two pieces, the word "tree" is spelled Such can also be done by linking two or more than three pieces together. Other images, text, or combinations can be used as would be within the skill of the art. The indicia on the building pieces can be formed integrally therein, applied with stickers, paint, printing, or the like.

The building and connector pieces can be made of any durable material that will withstand numerous instances of handling and game play. Preferably, the. pieces are made of a hard plastic. The building pieces can be made in a variety of colors to enhance play. The building and connector pieces when made of plastic can be made by any known means, including extrusions for the connectors, and. molding processes for the building pieces. The connector pieces can be extruded with a hollow center portion or a solid core.

As such, an invention has been disclosed in terms of preferred embodiments thereof, which fulfills each and every one of the objects of the present invention as set forth above and provides new and improved apparatus for entertainment and educational use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An interlocking apparatus for education and entertainment comprising a plurality of building pieces and a plurality of connector pieces, each building piece further comprising:

a) a building piece portion having a periphery, a first thickness, and opposing first and second faces;

b) the periphery comprising a first connector portion extending along at least a portion of the periphery, the first connector portion having a second thickness, and having one of a slot or a protrusion;

c) each connector piece having at least a pair of second connector portions, each connector piece with its second connector portions being rigid, each second connector portion being complementary to the first connector portion by having a slot if the first connector portion has a protrusion or a protrusion if the first connector portion has a slot, so that one building piece can be connected to another building piece using a connector piece, wherein a portion of the plurality of the connector pieces have second connector portions that are right angled with respect to each other and another portion of the plurality have second connector portions that are obliquely angled with respect to each other, whereby a three dimensional figure can be built using the building pieces and connector elements.

2. The apparatus of claim 1, wherein the first, connector portions have a slot and the second connector portions have a protrusion.

3. The apparatus of claim 1, wherein the first connector portions have a protrusion and the second connector portions have a slot.

4. The apparatus of claim 1, wherein the first connector portion extends along the entire periphery of the building piece.

5. The apparatus of claim 4, wherein the first connector portions are slotted and have an overall thickness greater than a thickness of the building piece portion so that at least one face of the building piece has a recess.

6. The apparatus of claim 5, wherein the recess is in the first face and the second face is generally flat.

7. The apparatus of claim 1, wherein each building piece and each connector piece is made of a rigid non-metallic material.

8. The apparatus of claim 1, wherein the plurality of connector pieces includes a first set of connector pieces that are right-angled with a pair of second connector portions; a second set of connector pieces that are t-shaped with three connector portions; a third set of connector pieces that have a pair of right-angled connector portions; and a fourth set of connector pieces that have a pair of second connector portions that are right-angled and a third connector portion which is angled at about 45° from one of the right-angled connector portions.

9. The apparatus of claim 1, wherein at least a portion of the building pieces have indicia on at least one of the first and second faces, indicia on connected and adjacent building pieces forming one of an image or text message, or a combination thereof.

10. The apparatus of claim 1, wherein the periphery of each building piece is made up of a plurality of edges, at least two edges being right angled, and dimensions of the right angled edges of the plurality of connector pieces are in multiples of a base dimension associated with all building pieces so that either individual building pieces can be connected together or an individual building piece can connect to at least two building pieces.

11. The apparatus of claim 1, wherein each slot has a slot depth coinciding with a length of the each protrusion.

12. The apparatus of claim 1, wherein at least a portion of the plurality of building pieces have curved peripheries, and a portion of the connector pieces have complementary curves to the curved peripheries.

13. An interlocking apparatus for education and entertainment comprising a plurality of building pieces and a plurality of connector pieces, each building piece further comprising:

a) a building piece portion having a periphery, a first thickness, and opposing first and second faces;

b) the periphery comprising a first connector portion extending along at least a portion of the periphery, the first connector portion having a second thickness, and having one of a slot or a protrusion;

c),each connector piece having at least a pair of second connector portions, each second connector portion being complementary to the first connector portion by having a slot if the first connector portion has a protrusion or a protrusion if the first connector portion has a slot, so that one building piece can be connected to another building piece using a connector piece, wherein a portion of the plurality of the connector pieces have second connector portions that are right angled with respect to each other and another portion of the plurality have second connector portions that are obliquely angled with respect to each other, whereby a three dimensional figure can be built using the building places and connector elements, wherein the first connector portions have a slot and the second connector portions have a protrusion, and each connector piece has a body portion with each second connector portion extending therefrom, the body portion including a lip on either side of the connector portion, the lip abutting a peripheral edge of a the first connector portion when the connector piece is adjacent a building piece, the body portion sized with respect to the second connector portion so that a body portion surface is interposed between surfaces of adjacent building pieces to form a continuous generally flat surface between the adjacent building pieces.

14. A method of forming a game apparatus comprising:

a) providing a game apparatus comprising a plurality of building pieces and a plurality of connector pieces, each building piece further comprising:

i) a building piece portion having a periphery, a first thickness, and opposing first and second faces;

ii) the periphery comprising a first connector portion extending along at least a portion of the periphery, the first connector portion having a second thickness, and having one of a slot or a protrusion;

iii) each connector piece having at least a pair of second connector portions, each connector piece with its second connector portions being rigid, each second connector portion being complementary to the first connector portion by having a slot if the first connector portion has a protrusion or a protrusion if the first connector portion has a slot, so that one building piece can be connected to another building piece using a connector piece, wherein a portion of the plurality of the connector pieces have second connector portions that are right angled with respect to each other and another portion of the plurality have second connector portions that are obliquely angled with respect to each other, whereby a three dimensional figure can be built using the building pieces and connector elements; and b) selecting a number of game pieces and connector pieces, and connecting the game pieces together using the connector pieces to form the game apparatus.

15. The method of claim 14, wherein the building pieces have indicia thereon, and the connecting step further comprises putting together game pieces and connector pieces to form one or more of text or images using the indicia.

16. The method of claim 14, wherein the connector pieces employ protrusions, and the building pieces employ slots for connection, and the connecting step further comprises putting the game pieces together by engagement between the slots and the protrusions.

17. The method of claim 16, wherein each connector piece has a body portion, the body portion being sized so that surfaces thereof that are interposed between adjacent building pieces as part of the connecting step form a continuous surface between the adjacent building pieces.

* * * * *